US006438806B1

(12) United States Patent
Lin

(10) Patent No.: US 6,438,806 B1
(45) Date of Patent: Aug. 27, 2002

(54) SLIDE STRUCTURE FOR ZIPPER

(76) Inventor: Yu-Pau Lin, No. 151, Kung Erh Road, Wu Lin Tsuen Lung Tan Hsiang, Tao Yuan Hsien (TW)

( * ) Notice: Subject to any disclaimer, the term of this patent is extended or adjusted under 35 U.S.C. 154(b) by 0 days.

(21) Appl. No.: 09/754,071

(22) Filed: Jan. 5, 2001

(51) Int. Cl.[7] ..... A44B 19/26

(52) U.S. Cl. ..... 24/433; 24/419; 24/429; 24/420

(58) Field of Search ..... 24/429, 419, 420, 24/433, 712.1, 712.6, 713.6

(56) References Cited

U.S. PATENT DOCUMENTS

| | | | | | |
|---|---|---|---|---|---|
| 2,261,133 | A | * | 11/1941 | Grant | 24/419 |
| 3,368,249 | A | * | 2/1968 | Fukuroi | 24/429 |
| 3,820,203 | A | * | 6/1974 | Takamatsu | 24/429 |
| 4,823,447 | A | * | 4/1989 | Akashi | 24/429 |
| 5,195,221 | A | * | 3/1993 | Kanamaru et al. | 24/429 |
| 5,729,874 | A | * | 3/1998 | Mizuno | 24/429 |
| 5,809,622 | A | * | 9/1998 | Yaguramaki | 24/419 |
| 5,901,420 | A | * | 5/1999 | Oda | 24/420 |
| 5,970,586 | A | * | 10/1999 | Demel et al. | 24/563 |

FOREIGN PATENT DOCUMENTS

| | | | | |
|---|---|---|---|---|
| GB | 0769468 | * | 3/1957 | 24/419 |

* cited by examiner

*Primary Examiner*—Victor Sakran
(74) *Attorney, Agent, or Firm*—Rosenberg, Klein & Lee

(57) ABSTRACT

A slide structure for zipper comprises a slide body and a tab. The slide body has a top plate and a bottom plate, and the top plate and the bottom plate are connected by a connection part. Two sliding grooves are formed between the top plate and the bottom plate and on both sides of the connection part. The top plate of the slide body has two pivotal stages arranged along the lengthwise direction. The pivotal stage each has a pivotal groove at the center part thereof and the pivotal stage has a clamping cover. The pivotal end of the tab is engaged into the pivotal stage and clamped by the clamping cover.

5 Claims, 7 Drawing Sheets

SLIDE STRUCTURE FOR ZIPPER

FIELD OF THE INVENTION

The present invention relates to a slide structure for zipper, which has light weight, less material use while keeping sufficient strength.

BACKGROUND OF THE INVENTION

FIG. 1 shows a prior art slide structure for a zipper, the slide structure comprises a slide body 10*a* and a pulling tab 11*a* pivotally arranged on the slide body 10*a*. By operating the tab 11*a* to move the slide body 10*a*, the zipper can be opened or closed.

Moreover, an elastic plate 12*a* is arranged on the slide body 10*a* and has a locking part 13*a*. The locking part 13*a* can penetrate, from topside of the slide body 10*a*, into the inner part of the slide body 10*a*, thus clamping the position of the slide body 10*a* on the zipper. When the tab 11*a* is not pulled, the position of the slide body 10*a* is clamped. Therefore, the slide with such structure has self-locking function.

However, the slide with above-mentioned structure is generally made of zinc alloy by die-casting. To ensure sufficient structural strength, the slide body 10*a* should have enough thickness. Therefore, the slide body 10*a* is not sufficiently compact and light-weight to meet practical requirement.

SUMMARY OF THE INVENTION

It is an object of the invention to provide a slide structure for zipper, which has light weight, less material use while keeping sufficient strength.

To achieve above object, the slide structure for zipper according to the present invention has a slide body and a tab. The slide body has two sliding groove and has rounded concave groove on at least one surface thereof. The tab has a pivotal end on one side thereof and pivotally connected to top of the slide body.

The various objects and advantages of the present invention will be more readily understood from the following detailed description when read in conjunction with the appended drawing, in which:

DETAILED DESCRIPTION OF THE INVENTION

Figure 1:
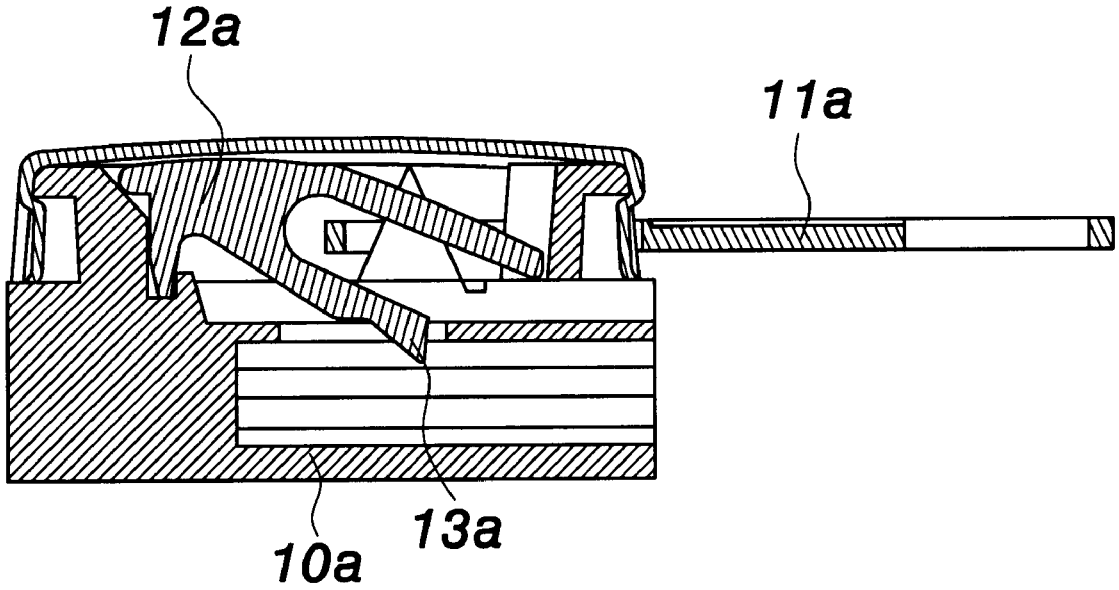
FIG. 1 PRIOR ART
FIG. 1 is a sectional view of prior art slide.
Figure 2:
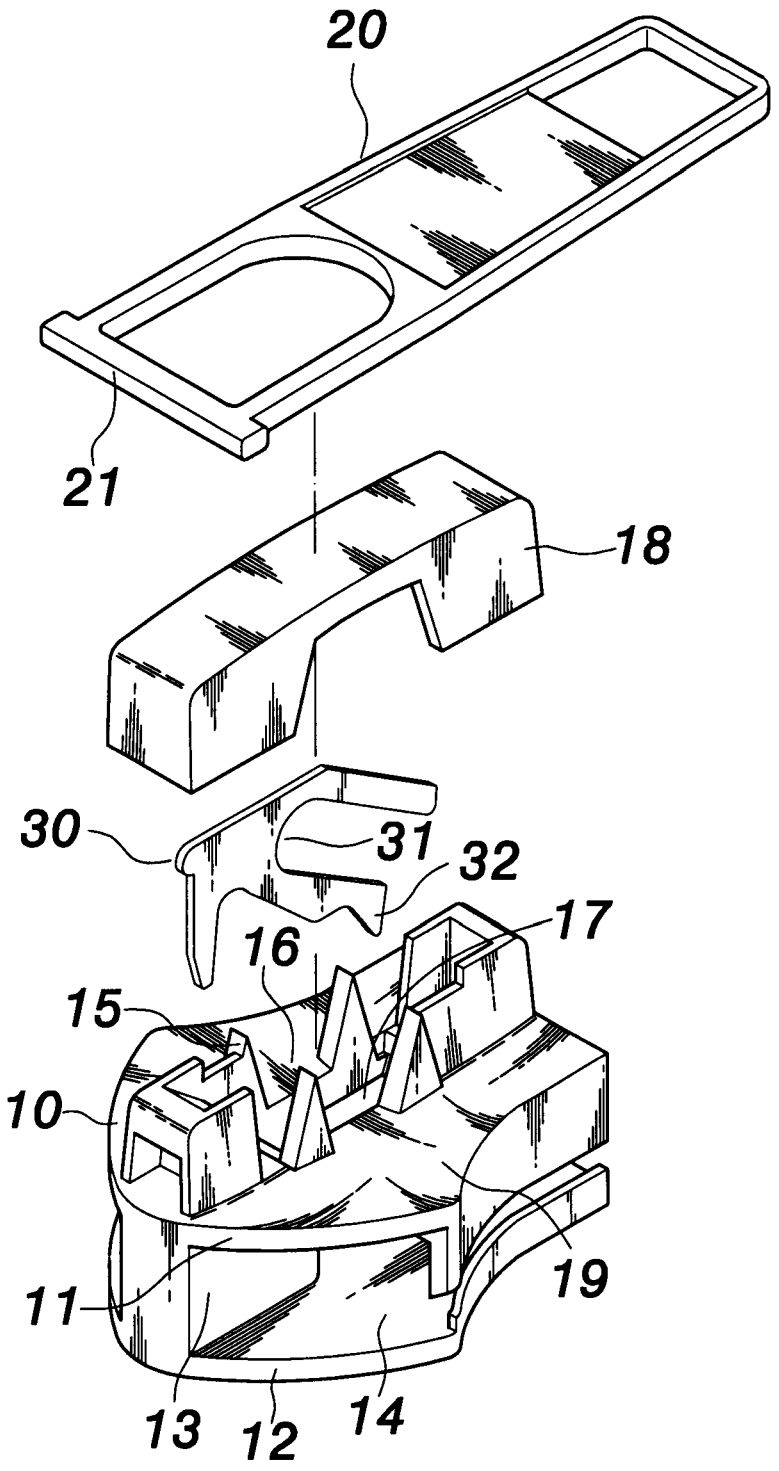
FIG. 2 is the exploded view of the present invention.
Figure 3:
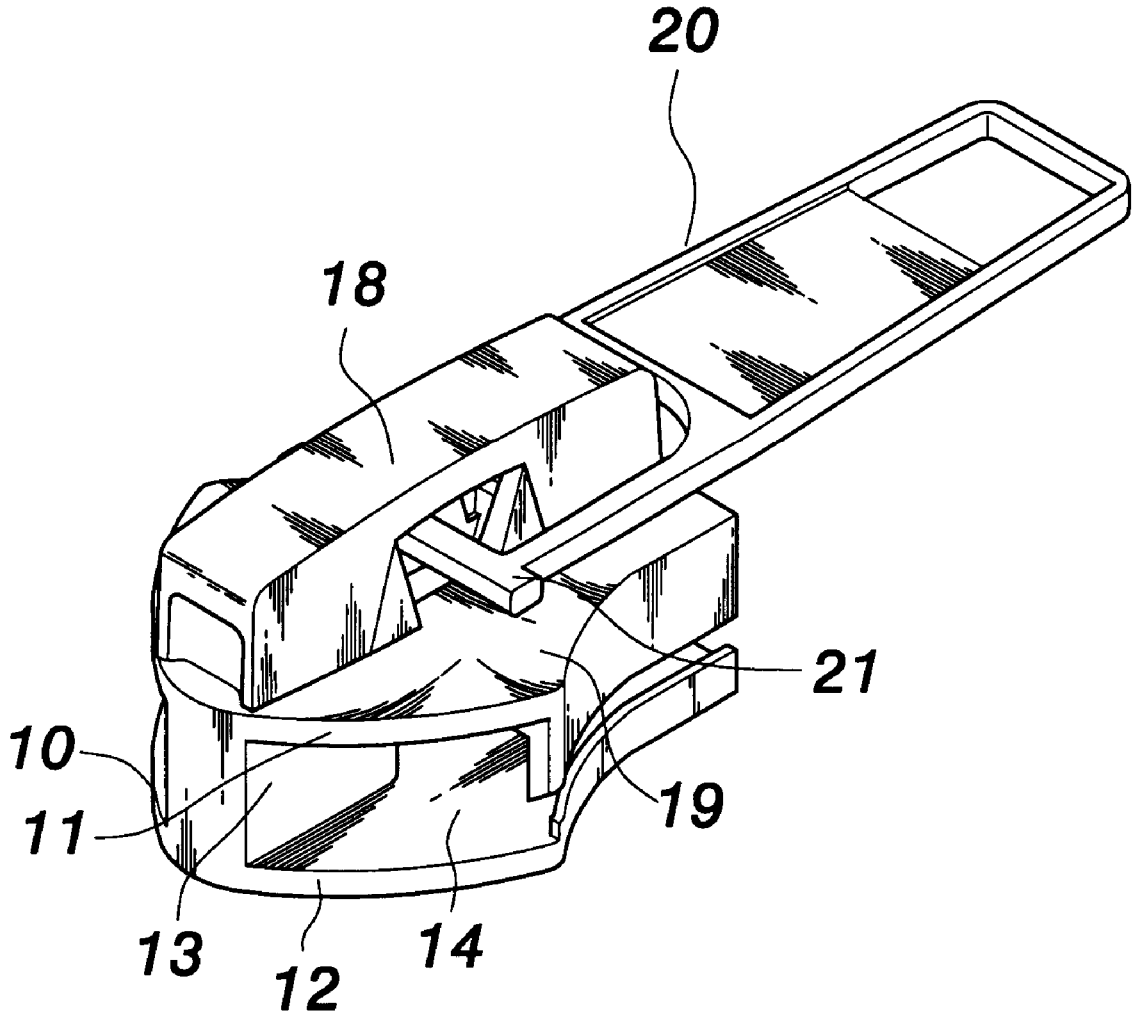
FIG. 3 is the perspective view of the present invention.

With reference now to FIGS. 2 and 3, the present invention is intended to provide a self-locking slide structure for zipper. The self-locking slide structure according to the present invention comprises a slide body 10, a pulling tab 20 and an elastic plate 30. The slide body 10 comprises a top plate 11 and a bottom plate 12 with a predetermined separation therebetween. The top plate 11 and the bottom plate 12 is connected by a connection part 13 and two sliding grooves 14 are formed between the top plate 11 and the bottom plate 12 and on both sides of the connection part 13 to receive the zipper (not shown). The top plate 11 of the slide body 10 has two pivotal. stages 15 arranged along the lengthwise direction. The pivotal stage 15 each has a concave-shape pivotal groove 16 at the center part thereof and the pivotal stage 15 has a U-shaped clamping cover 18 on the topside thereof. The top plate 11 of the slide body 10 has a through hole 17 between the two pivotal stages 15.

The tab 20 is of long-plate shape and has a pivotal end 21 on one end thereof. The pivotal end 21 is pivotally arranged within the concave-shape pivotal groove 16 of the slide body 10 such that the tab 20 is pivotally engaged on top of the slide body 10. The U-shaped clamping cover 18 is used to prevent the pivotal end 21 from escaping from the concave-shape pivotal groove 16 of the slide body 10, thus clamping the tab 20.

The elastic plate 30 is made of materials with good elasticity and has a bent part 31 to enhance the flexibility of the elastic plate 30. The bent part 31 has a locking part 32 on one end thereof. The elastic plate 30 is placed between the two pivotal stages 15 of the slide body 10 and is retained by the U-shaped clamping cover 18, thus preventing the elastic plate 30 from escaping from the two pivotal stages 15 of the slide body 10. Moreover, part of the elastic plate 30 is placed atop the pivotal end 21 of the tab 20. The locking part 32 of the elastic plate 30 passes through the through hole 17 of the slide body 10 and penetrates into a position between the sliding grooves 14 to lock on the zipper.

Figure 4:
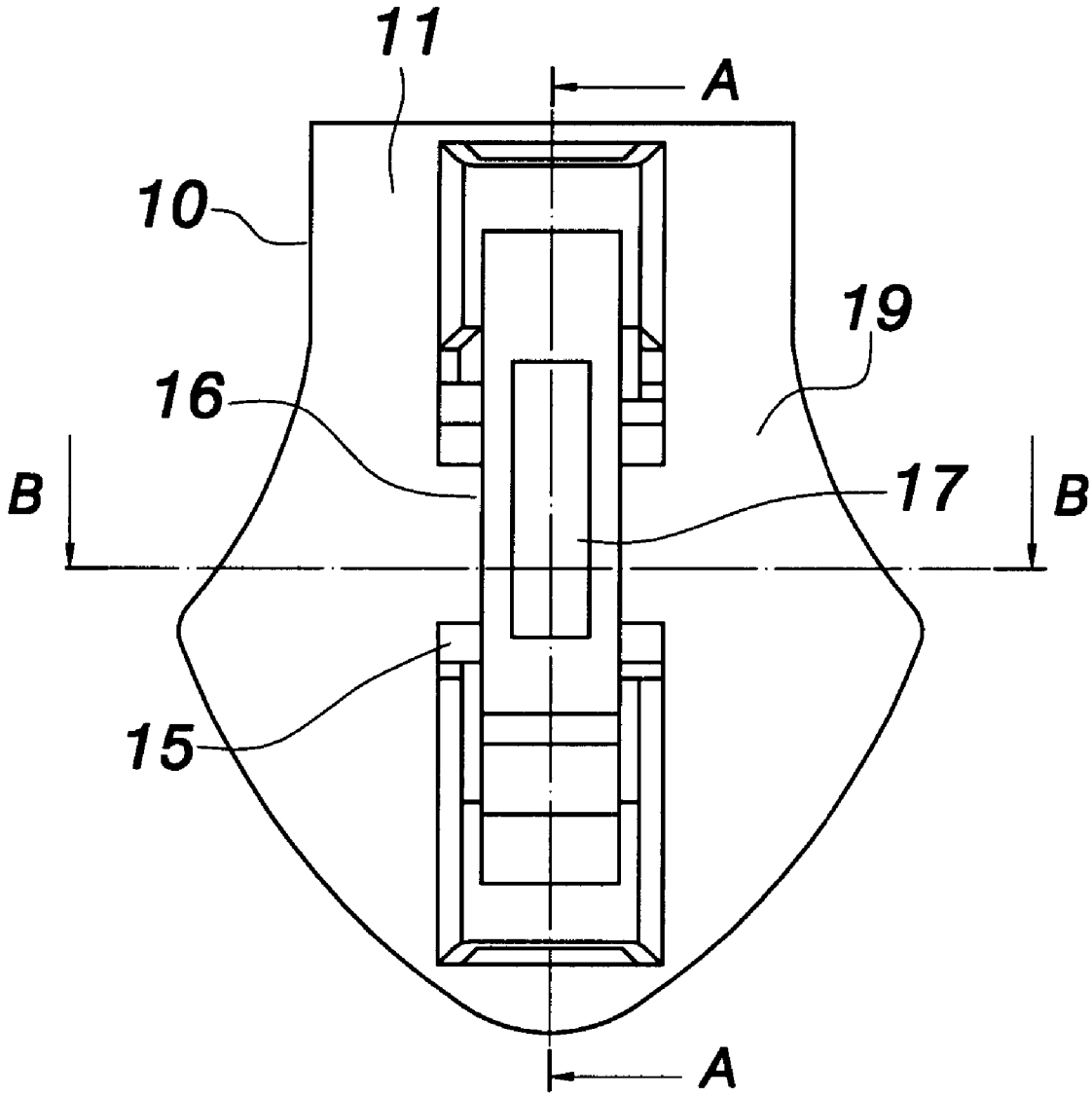
FIG. 4 is the top view of the slide body of the present invention.
Figure 5:
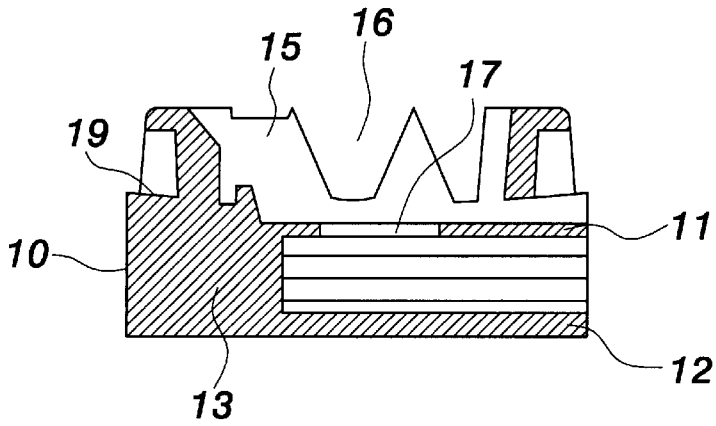
FIG. 5 is a sectional view along line A—A of FIG. 4.
Figure 6:
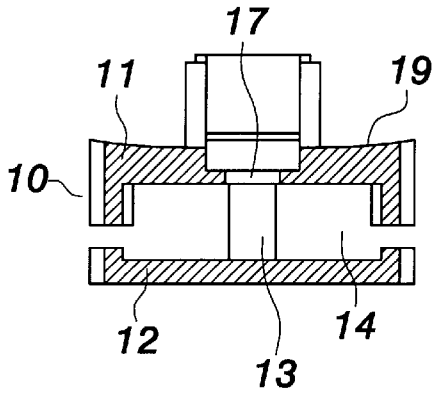
FIG. 6 is a sectional view along line B—B of FIG. 4.

The present invention is characterized that the slide body 10 has rounded concave groove 19 on at least one surface (with reference to FIGS. 4 to 6). In a preferred embodiment of the present invention, the slide body 10 has a rounded concave groove 19 on topside thereof. In other word, the slide body 10 has a rounded concave groove 19 on top plate 11 thereof. The rounded concave groove 19 is directly formed on the top plate 11 when the slide body 10 is shaped by die-casting zinc alloy.

The slide body 10 is assembled on the zipper (not shown) through the two sliding grooves 14 and the tab 20 is operated to control the open and close of the zipper. When the tab 20 is pulled, the pivotal end 21 pushes upward the elastic plate 30 and the locking part 32 is moved upward to escape from the zipper. As a result, the tab 20 smoothly drags the slide body 10 on the zipper to control the close and open of the zipper. When the tab 20 is released, the pivotal end 21 no longer pushes upward the elastic plate 30 and the locking part 32 of the elastic plate 30 is locked again to the zipper. Therefore, the slide body 10 is in a locked state.

Figure 7:
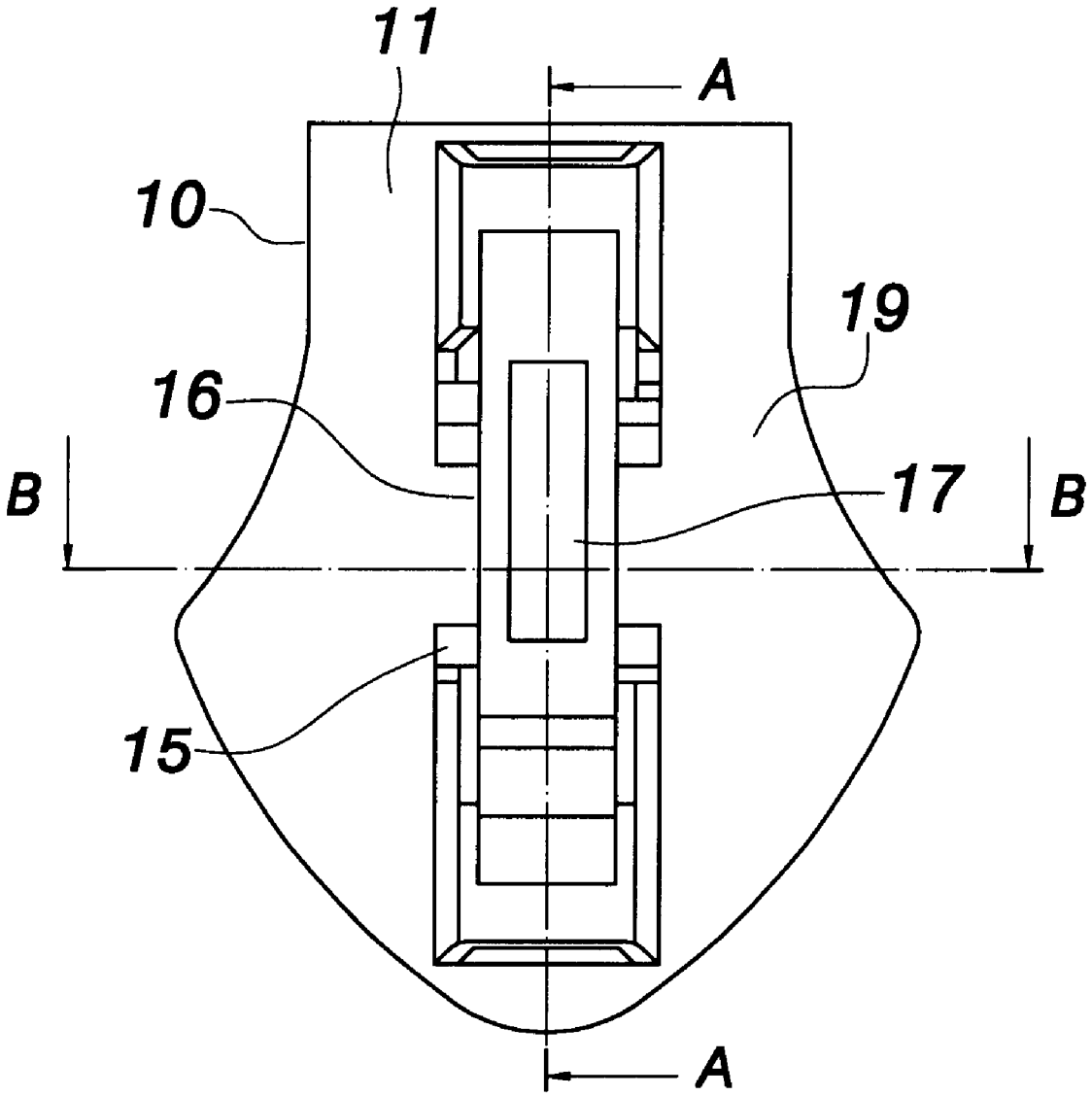
FIG. 7 is the top view of the slide body of another embodiment of the present invention.
Figure 8:
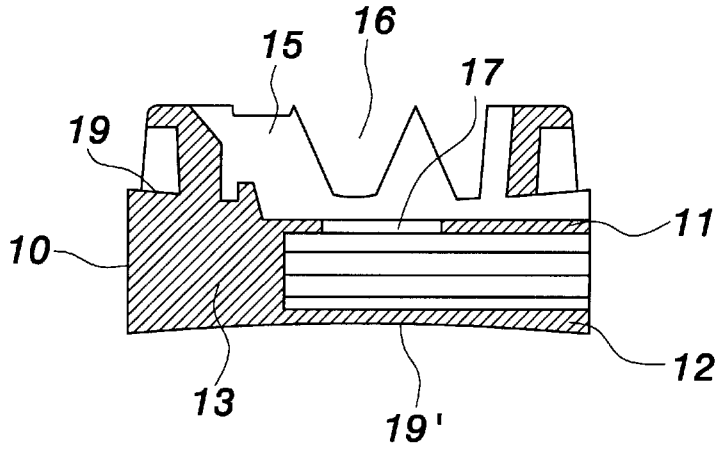
FIG. 8 is a sectional view along line A—A of FIG. 7.
Figure 9:
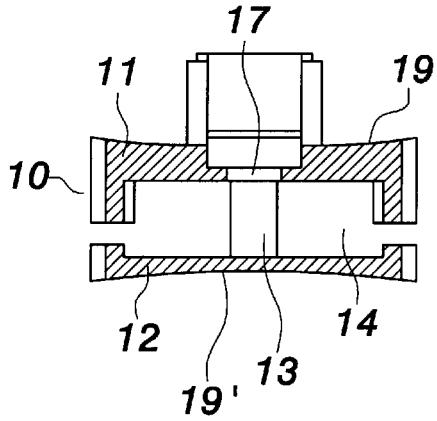
FIG. 9 is a sectional view along line B—B of FIG. 7.

With reference now to FIGS. 7 to 9, in this preferred embodiment, the slide body 10 has a rounded concave groove 19 and a rounded concave groove 19' on the topside and bottom side thereof, respectively. In other word, the slide body 10 has a rounded concave groove 19 on top plate 11 thereof and a rounded concave groove 19' on the bottom plate 12 thereof. Alternatively, the slide body 10 also can only have a rounded concave groove 19 on the bottom plate 12 thereof.

The present invention is characterized in that the slide body 10 is provided with rounded concave groove 19 (19'). The provision of the rounded concave groove reduces the weight of the slide body 10 while the structural strength of the slide body 10 is not influenced. The materials used and the cost of the slide body are reduced. Moreover, the cost of slide depends the processing and plating thereof. When the weight of the slide is reduced, the-cost thereof is reduced.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A slide apparatus for a zipper comprising:

a slide body having top and bottom plates joined by a connection part defining a pair of sliding grooves therebetween, said top plate having formed therein a through hole, said top plate including a top surface extending about said through hole, said bottom plate including a bottom surface;

at least one of said top and bottom surfaces describing a substantially concave surface contour, whereby the weight of said slide body is minimized without substantially compromising the structural integrity thereof.

2. The slide apparatus as recited in claim 1 wherein each of said top and bottom surfaces describes a substantially concave surface contour for minimizing the weight of said slide body without substantially compromising the structural integrity thereof.

3. The slide apparatus as recited in claim 1 further comprising a tab pivotally coupled to said slide body, and a clamping cover coupled to said slide body for retaining said tab coupled thereto.

4. The slide apparatus as recited in claim 3 wherein said slide body includes a pair of pivotal stages disposed on opposing sides of said through hole, said pivotal stages being pivotally engaged by a pivotal end of said tab.

5. The slide apparatus as recited in Claim 4 further comprising an elastic plate coupled to said slide body and said tab, said elastic plate including a locking part reversibly displaceable to extend through said slide body through hole responsive to a pivotal displacement of said tab.

* * * * *